US010267225B2

(12) United States Patent
Garrido Requena

(10) Patent No.: US 10,267,225 B2
(45) Date of Patent: Apr. 23, 2019

(54) INTERNAL COMBUSTION ENGINE

(71) Applicant: INNENGINE, S.L., Granada (ES)

(72) Inventor: Juan Garrido Requena, Armilla (ES)

(73) Assignee: INNENGINE, S.L., Granada (ES)

( * ) Notice: Subject to any disclaimer, the term of this patent is extended or adjusted under 35 U.S.C. 154(b) by 0 days.

(21) Appl. No.: 15/030,356

(22) PCT Filed: Nov. 4, 2013

(86) PCT No.: PCT/EP2013/072921
§ 371 (c)(1),
(2) Date: Apr. 18, 2016

(87) PCT Pub. No.: WO2015/062673
PCT Pub. Date: May 7, 2015

(65) Prior Publication Data
US 2016/0237890 A1 Aug. 18, 2016

(51) Int. Cl.

| | |
|---|---|
| ***F01B 7/12*** | (2006.01) |
| ***F02B 75/28*** | (2006.01) |
| ***F02B 25/08*** | (2006.01) |
| ***F01B 3/10*** | (2006.01) |
| ***F02D 15/00*** | (2006.01) |
| ***F01B 3/04*** | (2006.01) |

(Continued)

(52) U.S. Cl.
CPC ..... *F02B 75/28* (2013.01); *F01B 3/045* (2013.01); *F01B 3/101* (2013.01); *F02B 25/08* (2013.01); *F02B 75/02* (2013.01); *F02B 75/32* (2013.01); *F02D 15/00* (2013.01); *F02B 2075/026* (2013.01)

(58) Field of Classification Search
CPC combination set(s) only.
See application file for complete search history.

(56) References Cited

U.S. PATENT DOCUMENTS 1,817,375 A * 8/1931 Imblum ..... F02B 75/222 123/54.3
2,431,686 A 12/1947 Deschamps
(Continued)

FOREIGN PATENT DOCUMENTS

EP 0357291 3/1990
GB 855553 12/1960
(Continued)

OTHER PUBLICATIONS

International Search Report and Written Opinion for International Application No. PCT/EP2013/072921, dated Jul. 15, 2014, 8 pages.

*Primary Examiner* — Lindsay Low
*Assistant Examiner* — Ruben Picon-Feliciano
(74) *Attorney, Agent, or Firm* — Squire Patton Boggs (US) LLP

(57) ABSTRACT

It comprises one or more cylinders with pistons therein and mutually opposed power cams connected to respective first and second rotary shafts. The reciprocating pistons act on the power cams to impart a rotating motion to the rotary shafts. An attachment device is provided for connecting the rotary shafts to each other. The attachment device includes a shifting device for changing the relative angular position of the first and second rotary shafts. The result is engine distribution and compression ratio are changed dynamically.

19 Claims, 11 Drawing Sheets

(51) Int. Cl.
*F02B 75/02* (2006.01)
*F02B 75/32* (2006.01)

(56) References Cited

U.S. PATENT DOCUMENTS

| | | | | | |
|---|---|---|---|---|---|
| 2,957,462 | A * | 10/1960 | Clark | F01B 3/0035 | 123/51 B |
| 5,551,383 | A | 9/1996 | Novotny | | |
| 6,125,819 | A * | 10/2000 | Strieber | F01B 3/0079 | 123/190.14 |
| 2016/0195008 | A1 * | 7/2016 | Mercier | F01B 7/04 | 123/207 |

FOREIGN PATENT DOCUMENTS

| | | | | |
|---|---|---|---|---|
| JP | S63230947 | A | 9/1988 | |
| JP | H05503129 | A | 5/1993 | |
| JP | H11257090 | A | 9/1999 | |
| JP | H11294258 | A | 10/1999 | |
| JP | 2001073780 | A | 3/2001 | |
| WO | WO 96/09465 | A1 | 3/1996 | |
| WO | WO 98/49436 | A1 | 11/1998 | |
| WO | WO 9849436 | A1 * | 11/1998 | F01B 3/04 |
| WO | WO 2005/008038 | A2 | 1/2005 | |
| WO | WO 2010/118457 | A1 | 10/2010 | |
| WO | WO 2012/113949 | A1 | 8/2012 | |

* cited by examiner

INTERNAL COMBUSTION ENGINE

This disclosure relates to engines such as internal combustion engines, and more specifically to opposed piston engines.

BACKGROUND ART

Opposed piston combustion engines are known in the art. In such engines at least one common cylinder is provided having one piston arranged at each end. Two opposed pistons generally form a combustion chamber. When combustion takes place therein the gases act against both pistons driving them in opposite directions.

In general, opposed piston engines are provided with intake ports arranged near one end of the cylinder and exhaust ports arranged near the opposite end of the cylinder, each driven by the respective piston.

There are opposed piston engines having crankshafts or having power cams for transmission of power. The present disclosure relates to opposed piston engines having power cams for transmission of power.

Examples of such engines are disclosed in U.S. Pat. No. 5,551,383, EP0357291 and WO2005008038. Engines are disclosed comprising opposed pistons adapted to reciprocate in opposite directions and a main shaft carrying two power cams. The pistons are provided at their driving end with followers or bearings acting on the power cams. Reciprocation of pistons results in rotary motion of the main shaft.

In WO2010118457, for example, a pair of pistons is positioned to reciprocate in opposite directions along the longitudinal axis of the cylinder. A combustion chamber is defined between the pistons. First and second shafts are provided connected to respective axially spaced cams, and aligned to each other. In operation, the first shaft rotates continuously in the opposite direction to the second shaft. The second shaft has a longitudinal bore through which the first shaft can extend and rotate. This engine is not adapted to change its configuration when in use.

WO2012113949 filed in the name of the same applicant discloses an engine comprising a central hollow shaft and hollow arms projecting therefrom and connecting to respective cylinders each having opposing pistons defining a chamber therebetween. The engine further comprises two opposed power cams onto which bearings formed in the respective pistons roll to drive the engine.

The main advantage of these combustion engines is that side loads are eliminated or at least greatly reduced. However, the above prior art combustion engines are expensive, especially when different engines having different characteristics must be manufactured. In addition, said prior art combustion engines are high fuel consumption and poor performance engines.

There is therefore a need for providing opposed piston engines that can be easy to manufacture irrespective of whether they are engines with different characteristics to each other and with high performance and power.

SUMMARY

The present internal combustion engine is of the opposed piston type. It comprises an engine block having preferably a cylindrical shape that can be made, for example, by machining. However, the engine block of the present opposed piston engine could be prismatic or even irregular in shape. This combustion engine may be a petrol or diesel engine, or even a biofuel engine. In one preferred embodiment, the present internal combustion engine may be a three-stroke engine. At least one cylinder is provided inside the engine block. One preferred embodiment is a three-stroke, twin cylinder opposed piston engine having at least some of the features that are given below. Cylinders may be arranged to work in any desired position, such as horizontal vertical or inclined.

At least first and second mutually opposed power cams are provided inside the engine block. Each of the power cams is connected to or is part of respective opposite ends of the first and second rotary shafts. Therefore, the power cams can be rotated together with their respective rotary shaft. Respective output shafts are connected to or are part of respective power cams. In operation, the first and second rotary shafts, the output shafts and the respective power cams are rotated together.

The first and second rotary shafts are aligned to each other. Said rotary shafts are preferably arranged in a central portion within the engine block. Spacing between the first and second rotary shafts is preferably provided between their respective ends such that they are next to each other but not in contact with each other.

As stated above, the present engine may comprise one or more cylinders. Depending on the number of cylinders, the power cams will have a different number of cam tracks defined by corresponding protruding areas. For example, for a twin cylinder engine, the power cams have two cam tracks defined by two respective protruding areas. This results in that the engine cycle is performed twice for each turn of the shaft with a good weight balance.

The cylinders of the present engine may be formed integral with the engine block. However, embodiments in which the cylinders are separated parts coupled to the engine block are not ruled out.

Within each cylinder two corresponding pistons are arranged. In use, pistons reciprocate along the longitudinal axis of the cylinder. Each piston comprises a piston head, a piston body and a connector. The connector is intended for mutually connecting the piston head and the piston body. The connector is formed like a connecting rod but with no or little oscillating movement. Little oscillating movement is preferred for accommodating small movements between parts due to manufacturing imperfections and tolerances. The connector may comprise a number of substantially parallel rods lightening the assembly. The parallel rods forming the connector are mutually joined by upper and bottom common shafts connecting the piston head and the piston body.

Between two pistons in each cylinder, a combustion chamber is defined. At least one spark plug or injector is provided inside the combustion chamber depending on whether the present engine is a petrol or diesel engine, for example.

Intake and exhaust ports are also formed in the engine block and associated with the chamber through each cylinder. One or more spark plugs (petrol engine) or fuel injectors (diesel engine) are provided in the chamber. Other engine types to which the present structure can be applied are not ruled out such as biodiesel engines, gas engines, etc. In the case of petrol engines, they can work with carburettor or indirect/direct injection, with direct injection being the most preferred.

The piston head carries compression piston segments. Such piston segments are arranged at one end of the piston, near the combustion chamber. The piston head also carries lubrication piston segments. The lubrication piston segments are arranged in one end portion of the piston head, that is, the piston skirt. Positioning of piston segments, especially the lubrication piston segments, is closely related to the piston stroke and the positioning of said intake and exhaust ports. The lubrication piston segments are preferably arranged as close as possible to the compression piston segments taking into account that in the compression stroke ports can not be opened for preventing oil from entering the ports and therefore the cylinders.

The piston body withstands the main loads when pressure gas is transformed into torque on the output shafts associated with the respective power cams.

The power cams are arranged at the respective outer ends of the first and second rotary shafts facing each other as stated above. Each of the pistons has a drive end that is adapted to act on the respective power cams such that reciprocation of the pistons results in that a rotating motion is imparted to the first and second rotary shafts to drive the engine.

In one example, two cam tracks are defined in each power cam defining equal wave tracks taking up 180° therein. Specifically, the power cam in one piston has two intake cam tracks while the power cam in the opposite piston has two exhaust cam tracks.

Exhaust and intake ports are provided accordingly formed in the engine block and associated with the chambers between pistons, as stated above. Exhaust ports are driven by exhaust pistons, that is, pistons associated with power cam having exhaust cam tracks, and intake ports are driven by intake pistons, that is, pistons associated with power cam having intake cam tracks. Opening and closing of ports is thus controlled by the profile of the cam tracks.

In one example of the present engine, each of the waves in the respective cam tracks define at least two portions, namely an ascending or compressing portion and a descending or power portion. Waves are designed such that the exhaust piston is advanced with respect to the intake piston. However, each of the waves in the respective cam tracks might define at least an additional flat portion between the compressing and the descending portions.

It is important to note that the intake and exhaust cam tracks do not have to be different from each other. In case that the intake and exhaust cam tracks are equal, said cam tracks should have a suitable angular shift.

Therefore, according to an important feature of the present engine, at of before the end of the power stroke, exhaust ports are open by the corresponding piston heads before intake ports, and at the beginning of the compression stroke exhaust ports are closed by the corresponding piston heads before the intake ports are closed.

According to an important feature of the present engine, an attachment device is provided. The attachment device is arranged, for example, inside the engine block. The attachment device is adapted for connecting the first and second rotary shafts to each other so that they can be rotated together. Therefore, in operation, the attachment device together with the first and second rotary shafts are rotating together. The portion of the first and second rotary shafts is suitably lubricated.

Such attachment device comprises shifting means. The shifting means may include a slider that can be moved, for example displaced along the longitudinal axis. Motor means such as a servomotor commanded by a suitable control unit can be used to actuate the slider.

As the slider is actuated, the first and second rotary shafts are caused to be rotated to each other, that is, their relative angular position is caused to be changed. This, in turn, results in that the relative angular position of the power cams is changed.

For this purpose, the slider may have teeth or channels suitable to engage with respective outer teeth or channels formed in the first and second rotary shafts. Specifically, the teeth or channels of the first and second rotary shafts are formed at their respective mutually adjacent or proximate ends. In one embodiment the teeth or channels of the slider are formed inside of it while the teeth or channels of the rotary shafts are formed outside the ends of said rotary shafts.

The teeth or channels of both the slider and the first and second rotary shafts may be helical, for example. In such embodiment, the teeth or channels of the first rotary shaft can be symmetrical with respect to the teeth or channels of the second rotary shaft. Furthermore, the plane of symmetry of the teeth in the first and second rotary shafts is perpendicular to the first and second rotary shafts therefore defining a helical gear.

Other geometries for the teeth or channels are also possible as long as the first and the second rotary shafts are rotated to each other as the shifting means are actuated.

Actuation of the shifting means causing the power cams and the first and second rotary shafts to be rotated to each other results in that the engine distribution and compression ratio are changed. Varying the engine distribution and compression ratio is performed dynamically and simultaneously and involves changing actuation of exhaust and intake ports during engine operation. The volume inside the combustion chamber is also varied and therefore the engine compression ratio as explained below.

Variable distribution is advantageously achieved in simple way allowing higher torque to be delivered over a wide range of engine speeds. Opening and closing of intake and exhaust ports fit at any time to engine requirements. This is important advantage since it greatly increases engine performance, and increased torque and power are obtained, with reduced consumption and pollutants.

Variable distribution can be controlled according to the requirements of the engine, such as engine speed, air pressure in the intake collector, throttle position, etc., which is controlled by the control unit. When the engine is at low speed (starting from an idling speed) an exhaust opening less anticipated than intake opening is sought since with such a less anticipated exhaust opening the pressure inside the cylinder can be released in time so that when intake port opens gases are allowed to enter as optimally as possible without shorting. With the present variable distribution engine, when intake ports open the pressure inside the cylinder is less than the pressure within the intake collector or the atmospheric pressure in order to facilitate the start of the intake of gas. The present variable distribution engine allows exhaust ports to be opened as late as possible to take full advantage of the energy released during the power stroke and to obtain the highest possible power on the output shafts. On the other hand, as the engine speed is increased (although this also depends on many other variables as stated above, the engine speed is the most important), it is important that the opening of the exhaust port is anticipated and thus compensating for the shorter time available to release the pressure inside the cylinder before opening the intake ports.

All of this is achieved by suitably varying the relative angular position of the power cams relative to each other properly. The exhaust and intake cam tracks are slightly rotated in a way that the exhaust cam track is advanced relative to the intake cam track or in a way that the intake cam track is delayed relative to the exhaust cam track. This involves that as the slider of the attachment device is moved relative to its zero position (idling) the exhaust cam track rotates advanced relative to the intake cam track causing the exhaust ports are opened before the intake ports in the power stroke, and that the exhaust ports are closed before the intake ports in the compression stroke. It is important to note that the more the slider is displaced the more the exhaust is advanced relative to the intake, that is, the sooner the exhaust port is opened and closed relative to the intake port. Distribution is therefore dynamically varied.

Compression ratio is also advantageously achieved in simple way through actuation of the attachment device that couples the first and second rotary shafts. This allows the compression ratio of the engine to be dynamically adjusted when the engine is in operation. In this way, the fuel efficiency can be increased while the engine is working under varying loads. Specifically, pistons are at the top dead centre (TDC) and the slider is in its rest position or zero position (no relative rotation occurs in first and second shafts). Ideally, this position coincides with that of the engine when idle so that cam tracks in both power cams coincide. Note that, as stated above, in the case where the intake and the exhaust cam tracks are equal they have a suitable angular shift. In said position of the shifter the compression ratio is the highest which is suitable at low speeds. As the engine increases the speed the compression ratio is sought to be decreased so that the engine conditions are kept close to the optimum point of the engine at all times. This adjustment depends on several engine parameters (not only the engine speed) such as air pressure in the intake collector, engine loads, throttle position (power demand), etc. Therefore, in order to reduce the compression ratio the shifter position is changed axially towards the first and the second shafts. This causes the exhaust cam track is advanced at a certain angle from the intake cam. The top of the intake cam track which is considered as the highest point is taken as reference for ignition of the spark plug in petrol engines (or actuation of injection in a diesel engines). Thus, when the intake piston is in its highest point (TDC position), the exhaust piston has begun to move to be below its TDC position thus increasing the combustion chamber and consequently decreasing the compression ratio. Therefore the shifter, commanded by the control unit, is moved continuously so that the compression ratio is better adapted to requirements and needs of the engine.

The engine distribution and compression ratio are varied simultaneously and dynamically by the attachment device.

At least two possible configurations for the cam profiles and for the way the attachment device works are envisaged, which mainly influences its starting point and the initial rotation angle (at idle speed).

The first possible configuration is that the cam tracks are designed so that in the power stroke the exhaust ports are opened first and in the compression stroke they are closed first. In this way, at an idle speed the top of the cam tracks are aligned. As stated above, this position corresponds to a zero position of the attachment device. Therefore, the exhaust track is not required to be advanced relative to the intake track. The exhaust ports are opened before the intake ports at the end of the power stroke and they are closed before the beginning of the compression. From this position, when the engine output shaft rotates, the attachment device is moved through the servomotor, commanded by the control unit, as stated above, causing the inner teeth or channels of the slider to act on to those in the first and second rotary shafts at angle causing the first and second rotary shafts to be rotated to each other, that is, relative angular position of the power cams is changed resulting in that the engine distribution and compression ratio are dynamically and simultaneously varied.

Another possible configuration of the cam tracks is to make the peaks and valleys of the waves equal and the exhaust and intake cam tracks equal. In this case, for the engine to work, the attachment device must start (at an idle speed) from a position in which the exhaust cam track is rotated a suitable angle with respect to the intake cam track. With this configuration, the engine can be operated in both directions of rotation.

Respective counter cams are formed in correspondence with each power cam and associated therewith. The counter cams are thus attached to or are part of the respective first and second shafts and also attached to or are part of the respective power cams. The diameter of the counter cams is preferably smaller than that of the power cams. The counter cams have the same shape as their corresponding power cams, and they are facing each other. The purpose of the counter cams is to prevent collisions of the pistons in the same cylinder which could occur when inertial forces of the pistons are in opposite direction to those of the power cams and the force of the gas pressure inside the cylinder or cylinders is lower than said inertial forces. The first and second rotary shafts rotate together with the power cams and the counter cams.

In the specific example of a twin cylinder engine and as stated above two cam tracks are defined in each power cam defining equal wave tracks such that the power cam in one piston has two intake cam tracks while the power cam in the opposite piston has two exhaust cam tracks. Specifically, each cylinder has, at one side, intake ports controlled by piston heads which in turn are controlled by the intake cam tracks provided in a power cam. At the opposite side of the cylinder, exhaust ports are provided controlled by piston heads which in turn are controlled by the exhaust cam tracks provided in the opposite power cam.

In one particularly preferred embodiment, a twin cylinder engine is provided. The two cylinders are located on either side of the first and second shafts, that is, the two cylinders are separated 180° from each other in the shaft axial direction. The two pistons are slidingly received inside each cylinder facing each other for driving the respective power cams and counter cams as stated above.

Cylinder's exhaust and intake ports are opened and closed by the piston heads according to the shape of the cam tracks and their rotation. The shape of the cam tracks is such that in the power stroke the exhaust ports are first opened and in the compression stroke the exhaust ports are first closed as stated above.

Each piston comprises a piston head, a piston body and a connector. The connector is a kind of connecting rod but it does not swing. The connector connects the piston head and the piston body together. The piston head carries compression rings at the end closest to the combustion chamber, and lubrication rings at the lower part of the piston head (skirt). The position of the piston rings (especially lubrication rings) is closely related to the piston stroke and the position of the cylinder ports. The piston body is designed to withstand stresses when transforming gas pressure into shaft torque.

The pistons may comprise at least one cam follower wheel, for example two or three cam follower wheels. The follower wheels are adapted to roll on the power cam as the piston moves. The pistons may further comprise at least one counter cam follower wheel, for example a single counter cam follower wheel. The counter cam follower wheel is adapted to roll on the counter cam. In one preferred embodiment, the follower wheels and the counter cam follower wheel(s) are all mounted on a common shaft. In one embodiment, said common shaft is at least substantially perpendicular to the first and second shafts and to the longitudinal axis of the cylinders.

Each cylinder may be further provided with locking means for preventing the piston from being rotated such that in operation, the piston is only allowed to be displaced. The locking means may comprise a groove formed along the piston intended for receiving a projection formed in the cylinder. The locking means could alternatively comprise a projection formed in the piston intended for receiving a groove formed along in the cylinder. Other equivalent locking means could alternatively be included for preventing the piston from being rotated.

It is preferred that the cylinders are provided with two equal indentations formed at both ends adapted for the counter cam follower wheels to not collide with the cylinders during the compression stroke.

This is important as it prevents to reduce piston weight avoiding vibrations, and reducing leverage effect between cylinder and piston body due to the smaller overhang during power stroke, less friction and the engine would be more compact in size.

The cylinders are preferably forced air-cooled but they can be also liquid cooled. A finned area is provided around the cylinders through which forced air flows from cooling fan. Specifically said finned area is provided in the intermediate space between the outermost portion of the cylinder body and the cylinder where the pistons are received. Forced air is flows through said intermediate portion coming from the cooling fan. Cooling is thus performed in a better-distributed and efficient way.

Respective lubrication portions are defined between the opposite end portions of the engine block and the engine block itself.

In use, from the top dead centre (TDC) where pistons are at the top of their respective cam tracks, and therefore they are close to each other, gases are compressed at high temperature inside the combustion chamber between the cylinder and the two piston heads. Ignition, for example, caused by spark plugs, of the gas mixture results in that temperature and pressure are increased within the chamber pushing the pistons and causing them to move. In this power stroke the linear movement of the pistons is transformed into rotational movement when acting on the power cams thus driving the engine output shafts.

Near the end of the power stroke exhaust ports are opened by the piston head causing exhaust of gases due to pressure differential of the cylinder and the exhaust collector. As stated above, opening of the exhaust ports is carried out in advance in order to ensure that when the intake ports are opening, pressure inside the cylinder has dropped sufficiently to allow fresh gases entering through the intake ports. During the cycle step where intake and exhaust ports are open fresh gases from the intake collectors exhaust gases are swept through the exhaust ports. Shortly after starting the rising step, exhaust ports are closed by the exhaust piston heads while the intake ports continue opened at a given angle, such that cylinder intake is optimized. Once intake ports are closed compression starts. During the compression step the fuel is injected into the cylinder. Shortly before the TDC ignition starts again causing combustion.

Additional embodiments of the shifting means are envisaged. For example, one of the power cams may have a through hole along its shaft and the other power cam may have its shaft extended such that it passes through the other power cam to its rear portion. Up to this point the two power cams are allowed to rotate freely with no link between them. In this embodiment, the shifting means for rotating the two power cams to each other are received between the rear portion of the power cam with the through hole and the side crankcase. Said shifting means could also be provided outside the side crankcase.

A further embodiment is also envisaged in which the helical ramps interacting with the shifter comprise helical teeth and a secondary shaft is provided parallel to the cam shaft. Said secondary shaft has two helical gears meshing with each of the teeth of the shafts. Therefore, this secondary shaft rotates together with the power cam shafts and causes them to be rotated together. On the other hand, said secondary shaft can be displaced linearly such that the relative angle between the power cams is varied.

Finally, in a further embodiment of the shifting means the power cams and the corresponding shafts are not formed integrally with each other and the power cams can be slightly rotated relative to the corresponding shaft. Inside the power cams radially distributed chambers are defined. Within each of these chambers a wall is provided dividing the chamber into two areas. Said wall is formed integrally with the shaft and divides each chamber into two sub-chambers. In this way, when oil under pressure is suitably fed into each sub-chamber the power cams are caused to be rotated to the desired position.

In a further embodiment, the cam tracks are shaped such that peaks and valleys are equal. In this case, the slider should start from a position (idling) to a position in which the exhaust cam track is rotated a suitable angle with respect to the intake cam track. With this configuration, the engine can be operated in both directions of rotation.

It is preferred that the profile of the intake and exhaust cam tracks are similar to each other, and even equal, so that vibrations (especially at low speeds) are minimized since the exhaust and intake pistons move symmetrically. This results in that peak forces of the cylinders, piston body, power cams, etc., are greatly reduced, thus decreasing the wear, vibration, etc. The present engine is highly flexible in relation to design and calculation so it can be better configured for the use to which it is intended.

The present internal combustion engine provides many advantages. Said advantages include, but are not limited to, the common advantages of the known opposed piston engines where side loads are eliminated or at least greatly reduced and with a very simple and therefore cost effective construction. However, the most significant advantage of the present internal combustion engine is that distribution and compression ratio can be dynamically and simultaneously varied as the engine is running. Such dynamic and simultaneous variation of engine distribution and compression ratio are achieved in a very simple way resulting in higher torque over a wide range of engine speeds, opening and closing of intake and exhaust ports being fitted at any time to engine requirements, an increased engine performance, reduced pollutants and an increased fuel efficiency while the engine is working under varying loads.

Additional objects, advantages and features of embodiments of the present engine will become apparent to those skilled in the art upon examination of the description, or may be learned by practice thereof.

BRIEF DESCRIPTION OF THE DRAWINGS

Particular embodiments of the present opposed piston engine will be described in the following by way of non-limiting examples, with reference to the appended drawings.

In the drawings.

DETAILED DESCRIPTION OF EMBODIMENTS

Figure 1:
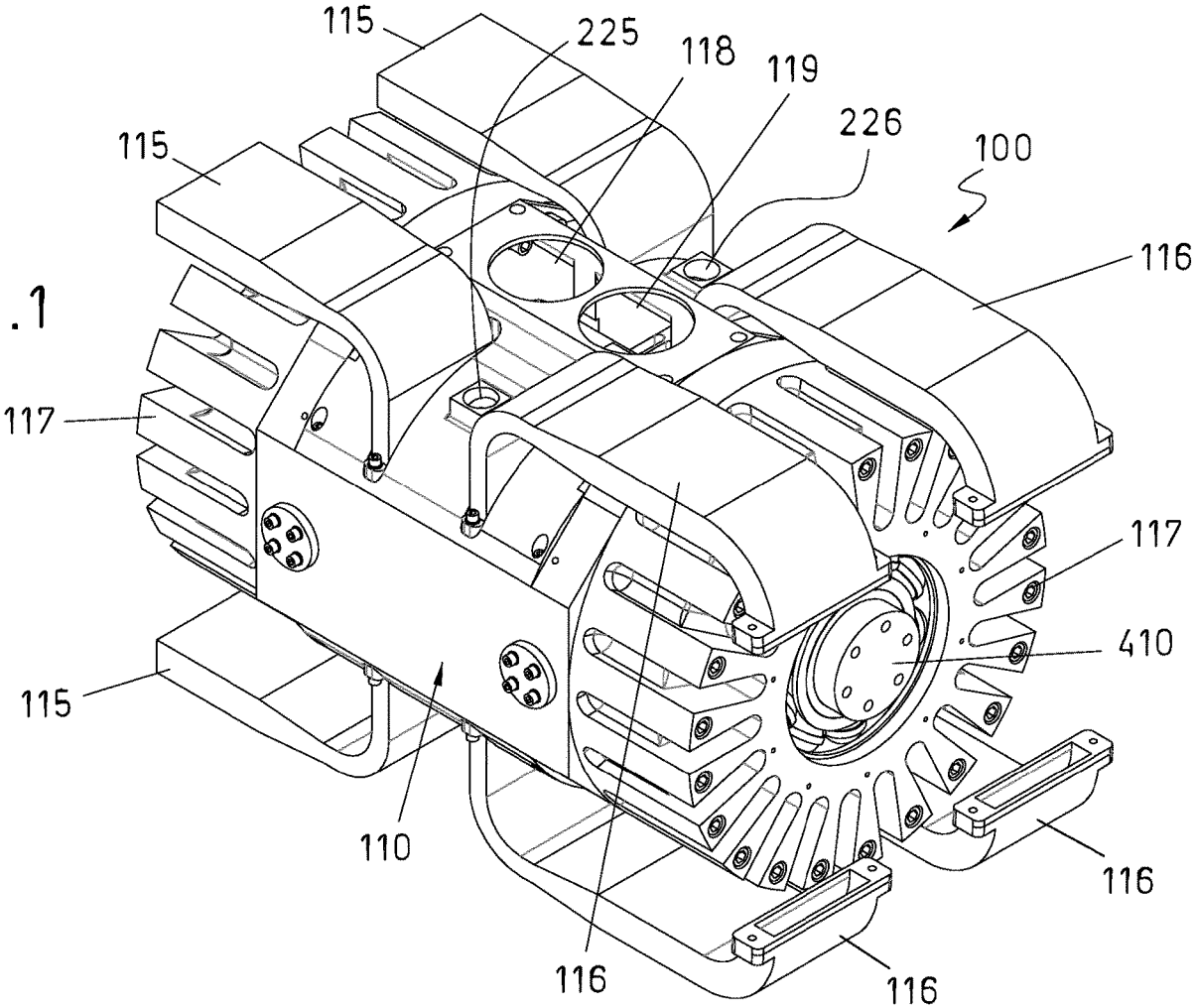
FIG. 1 is a general perspective view of one embodiment of a twin cylinder opposed piston direct injection petrol engine in which the engine block has been illustrated in its assembled condition, that is, assembled on the engine.

A twin cylinder, three-stroke, opposed piston, direct injection petrol engine is shown in the figures by way of an example. It been indicated as a whole by reference numeral 100.

As shown in FIG. 1 of the drawings, the opposed piston engine 100 comprises a cylindrical engine block 110. The embodiment shown in FIG. 1 is one possible example of an engine block 110. However, it could be different in shape, such as prismatic or irregular, according to the specific requirements. As shown in FIG. 1, holes 118, 119 are formed in the engine block 110 for cooling purposes.

Intake collectors 116 and exhaust collectors 115 are provided on the engine block 110. The intake and exhaust collectors 116, 115 lead to corresponding exhaust and intake ports (not shown).

Figure 3:
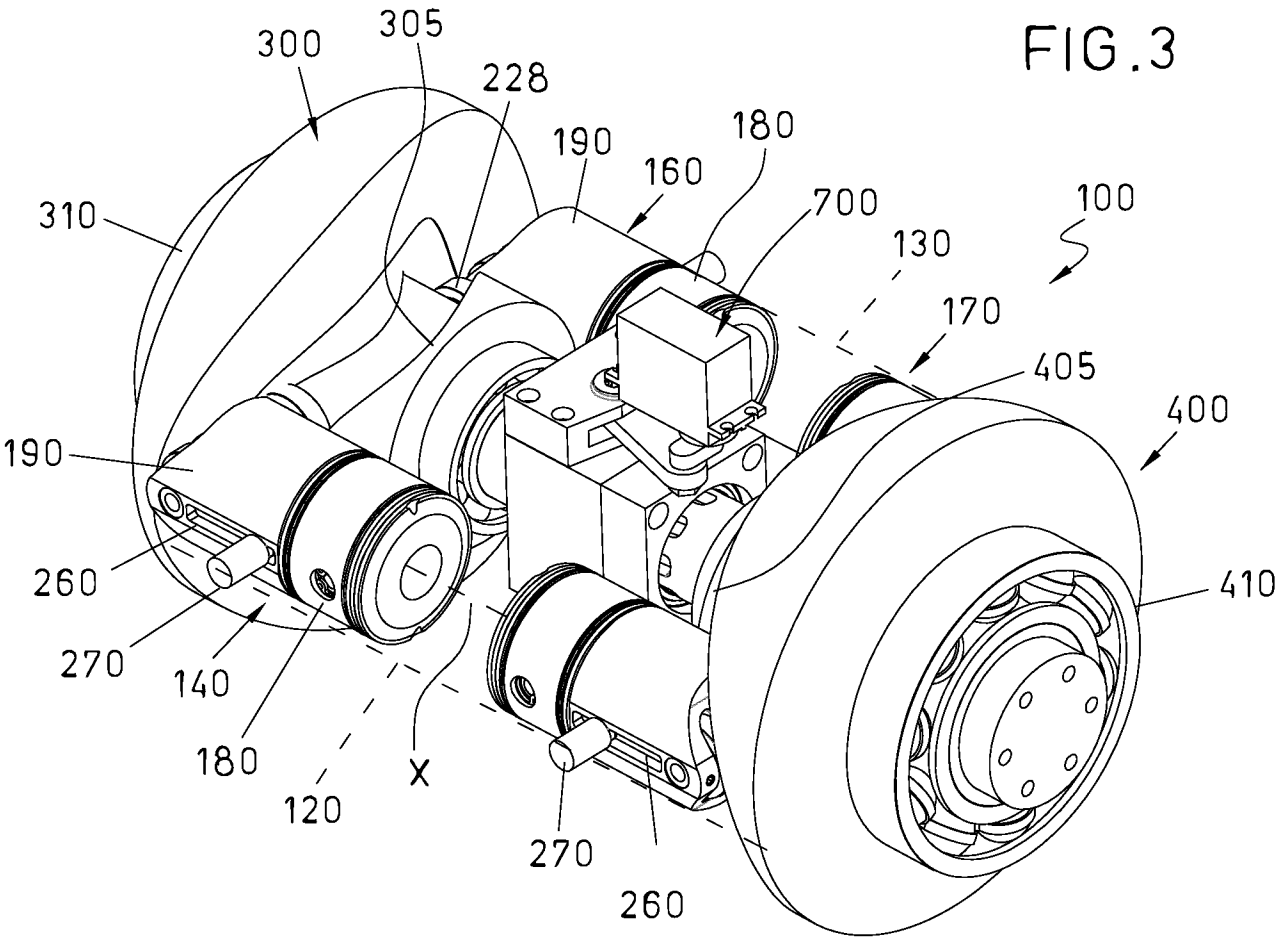
FIG. 3 is a general perspective view of the engine shown in FIG. 1 with the engine block in its disassembled condition, that is, removed from the engine.

From the perspective view of the engine 100 shown in FIG. 3, in which the engine block 110 has been removed from the engine 100, it can be seen two cylinders 120, 130. Cylinders 120, 130 have been depicted through dashed lines in order to shown the corresponding pistons 140, 150 and 160, 170 provided therein as it will be explained further below.

Cylinders 120, 130 are arranged inside the engine block 110 separated 180° from each other in the axial direction of their corresponding longitudinal axes X, parallel to each other. The cylinders 120, 130 are formed integral with the engine block 110 although they could be separated parts coupled to the engine block 110. The cylinders 120, 130 may be arranged to work in any desired position, such as horizontal, vertical or inclined.

The engine block 110 is further provided with side crankcases 117 located at its opposites ends as shown in FIG. 1, surrounding cylinders 120, 130. The side crankcases 117 house power cams 300, 400, that will be explained further below, within the engine block 110. The side crankcases 117 absorb piston expansion forces and define lubrication areas.

As stated above, two pistons 140, 150 and 160, 170 are provided within each cylinder 120, 130. Pistons 140, 150 and 160, 170 in their respective cylinder 120, 130 are aligned to each other such that in use, pistons 140, 150 and 160, 170 reciprocate along the longitudinal axis of the cylinder, that is, along their longitudinal axes X.

Pistons 140, 150 and 160, 170 are associated with the above mentioned intake and exhaust ports. Thus, exhaust ports are driven by exhaust pistons and intake ports are driven by intake pistons. Opening and closing of intake and exhaust ports is controlled as set out below.

Figure 2:
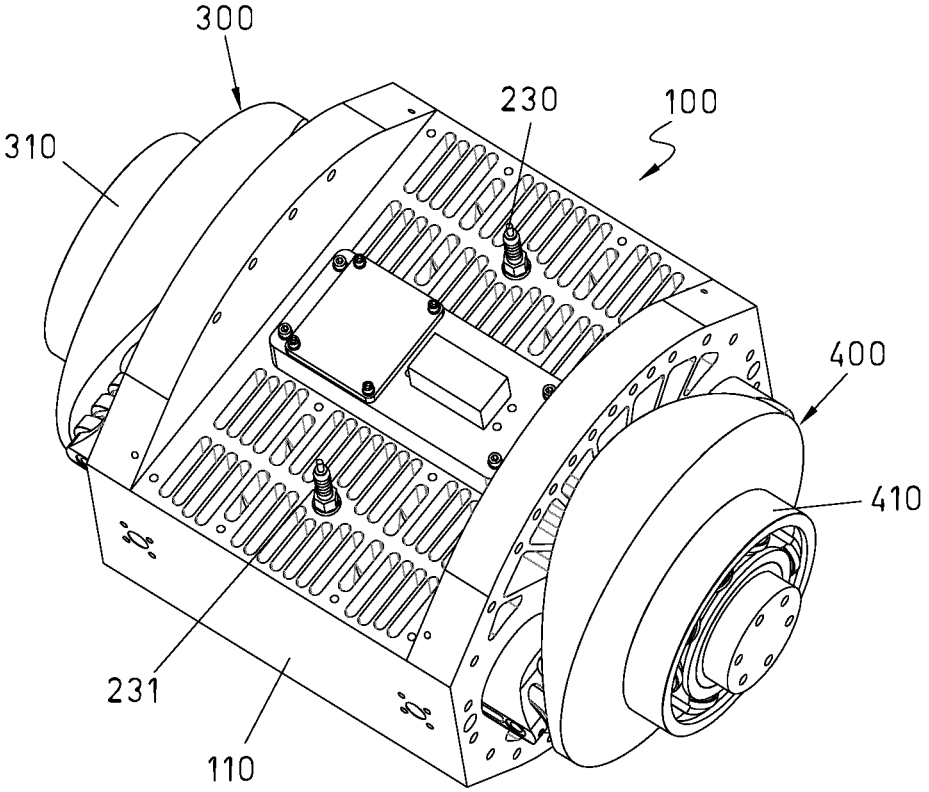
FIG. 2 is a general perspective view of the engine shown in FIG. 1 in which the engine block has been shown with the intake and exhaust collectors, the side crankcases and the cooling housings removed.
Figure 4:
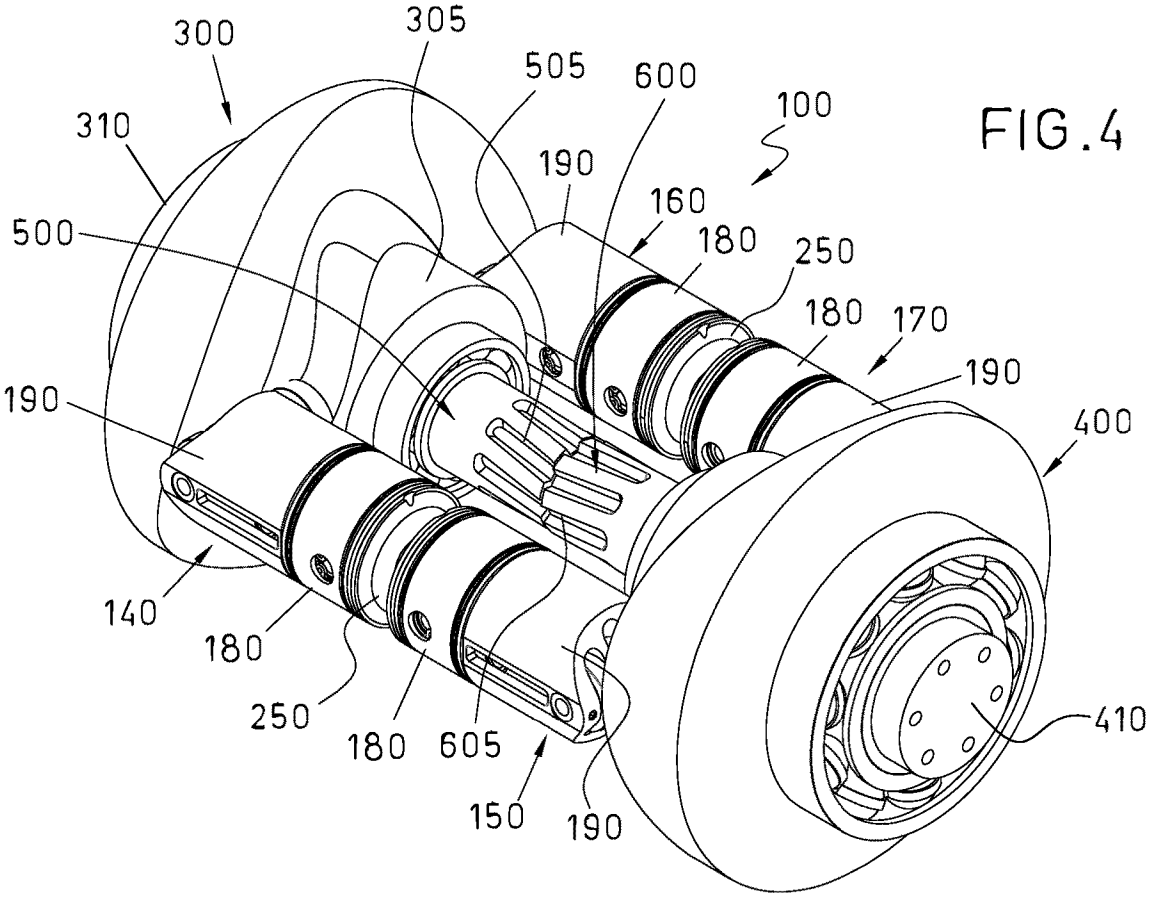
FIG. 4 is a perspective general view of the engine shown in FIG. 3 with the attachment device removed from the rotary shafts.

Within each cylinder 120, 130 a combustion chamber 250 is defined. Specifically, each combustion chamber 250 is formed by the space between two adjacent pistons 140, 150 and 160, 170 in each cylinder 120, 130, as shown in FIG. 4. Corresponding spark plugs are provided inside the combustion chamber 250 in each cylinder 120, 130. The spark plugs 230, 231 can be fitted through corresponding access holes 225, 226 formed in an upper housing and received inside the engine block 110, as shown in FIGS. 1-3 of the drawings. The above mentioned intake and exhaust ports are formed in correspondence with said chambers 250.

FIGS. 7-10 show one embodiment of the pistons 140, 150 and 160, 170. Pistons 140, 150 and 160, 170 each comprises a piston head 180, a piston body 190 and a connector 200. The connector 200 can be shown in the sectional view of FIG. 8. The connector 200 is formed like a connecting rod for connecting the piston head 180 with the piston body 190 to each other with no or little oscillating movement. In the embodiment shown in FIG. 8, the connector 200 comprises three parallel rods 210 mutually joined by a bottom common shaft 220 and an upper common shaft 221 which connect the piston head 180 and the piston body 190.

The piston head 180 carries compression and lubrication piston segments 185, 186 as shown in FIGS. 7-10. The compression piston segments 185 are arranged at one end of the pistons 140, 150 and 160, 170, near the combustion chamber 250. The lubrication piston segments 186 are arranged in the lowermost part of the piston head 180, close to the compression piston segments 185 taking into account that in the compression stroke ports can not be opened for preventing oil from entering ports and therefore the cylinder 120, 130.

Figure 10:
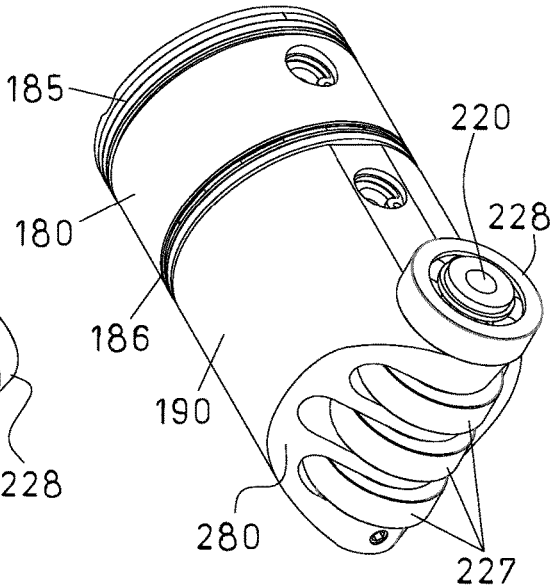

Each piston body 190 has an indentation 280 as shown in FIG. 10. The indentation 280 is formed at one end of each piston 140, 150 and 160, 170 and it is suitable for preventing the piston body from hitting the corresponding cam track. On the other hand, the cylinders 120, 130 have an indentation 125, 135 formed in opposite ends for allowing the counter cam follower wheel 228 to not collide with the cylinders 120, 130. This can be seen in FIG. 15 of the drawings.

Figure 15:
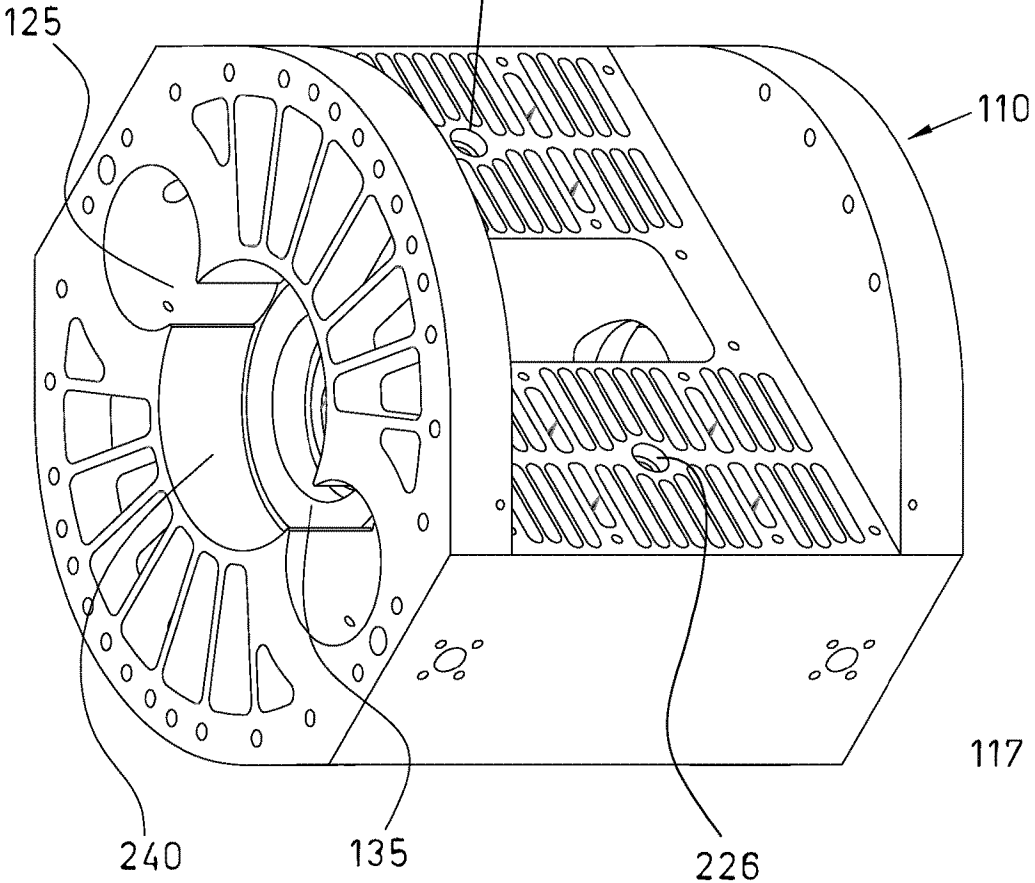
FIG. 15 is a perspective view of the engine block.
Figure 17:
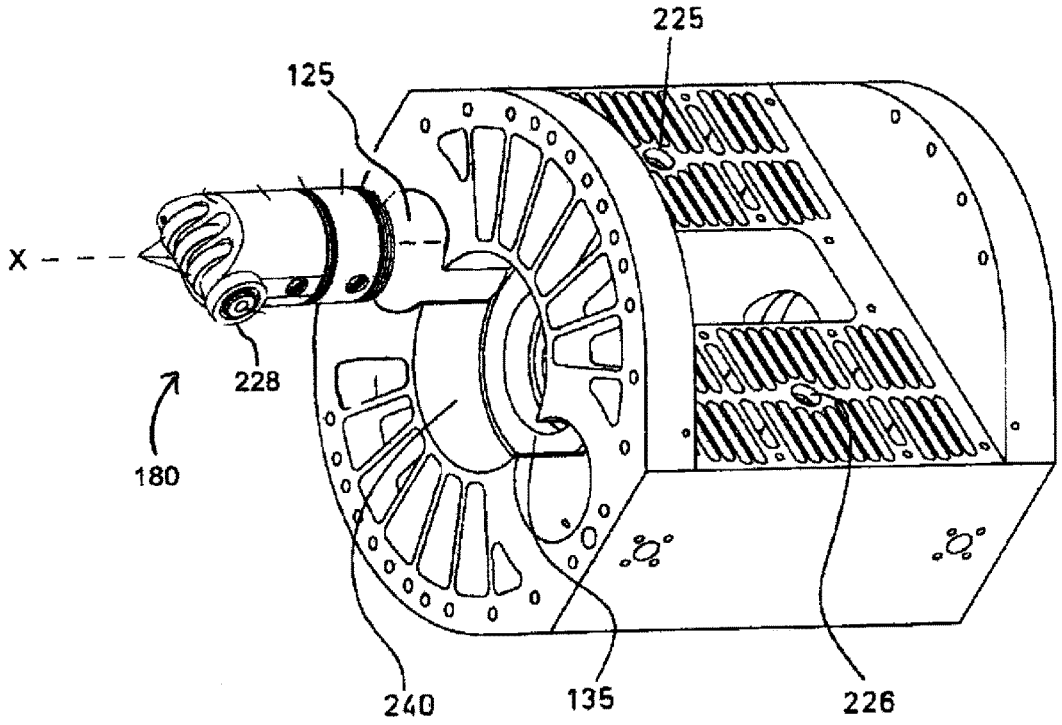
FIG. 17 shows a relationship among a piston and follower-wheel, cylinder and indentation in the cylinder.

FIG. 17 shows the relationship among the piston 180, follower wheel 228, and the cylinder 130, within which the piston 180 and follower wheel 228 reciprocate, and the indentation 125 in the cylinder 130. As shown in FIGS. 15 and 17, the indentiation 125 forms a longitudinally extending open space in the wall of the cylinder 130 and extends along the x axis. This open space allows the piston 180 and follower wheel 228 to reciprocate along the x-axis within the cylinder 130 without the follower wheel 228 colliding with the cylinder 130.

Pistons 140, 150 and 160, 170 are provided with locking means for preventing the pistons 140, 150 and 160, 170 from being rotated. The locking means, as shown in FIGS. 3 and 4, comprise a groove 260 formed along the piston body 190 intended for receiving a projection 270 formed in the cylinder 120, 130. The projection 270 may be attached to the cylinder 120, 130 or it may be integral therewith.

Figure 11:
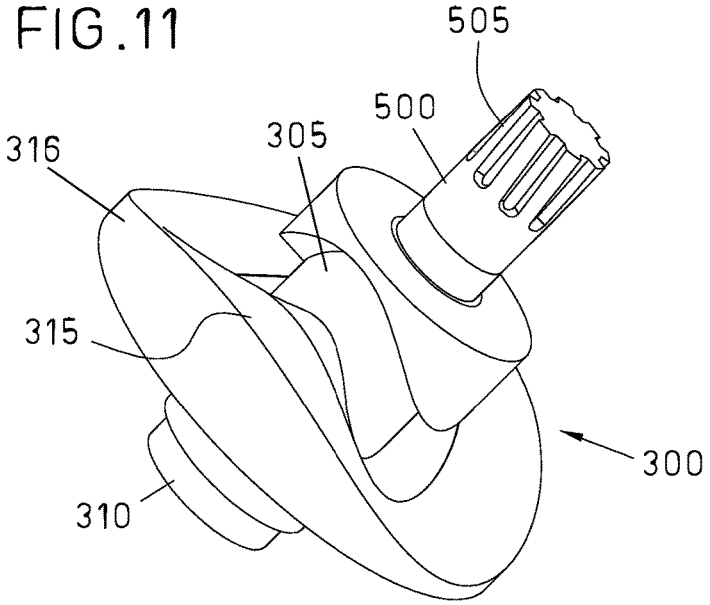
FIG. 11 is a perspective view showing one of the power cams and the respective counter cams.
Figure 12:
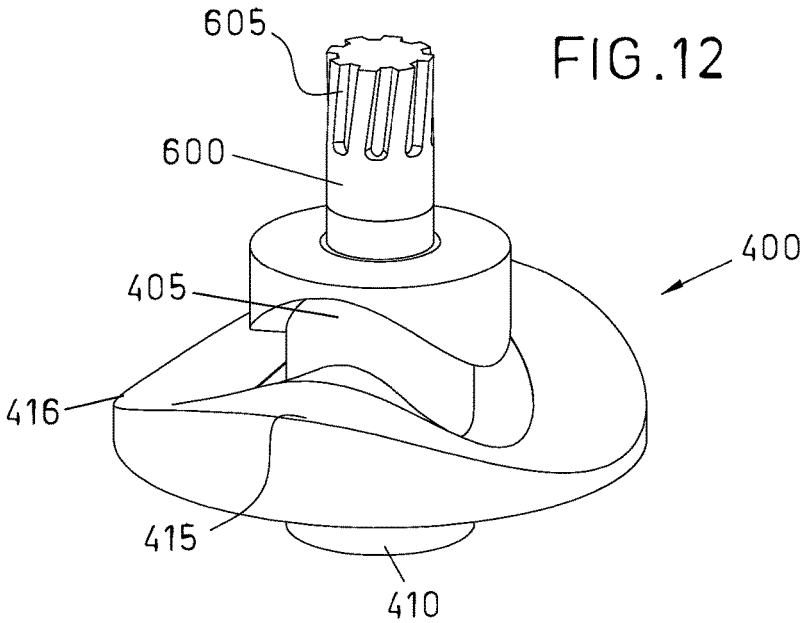
FIG. 12 is a perspective view showing the other power cam and respective counter cam.
Figure 13:
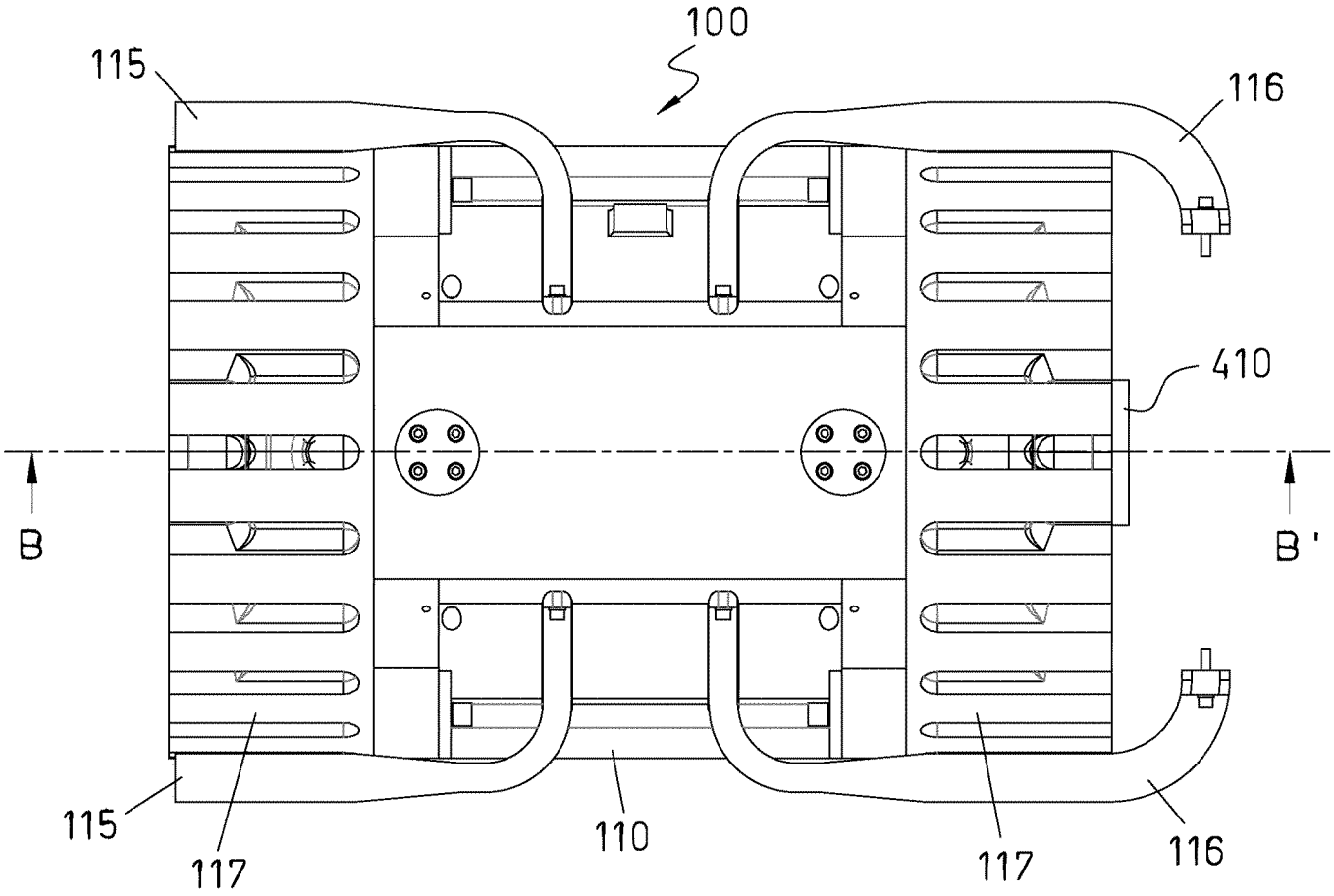
FIG. 13 is a side elevational view of the opposed piston engine shown in FIG. 1.
Figure 14:
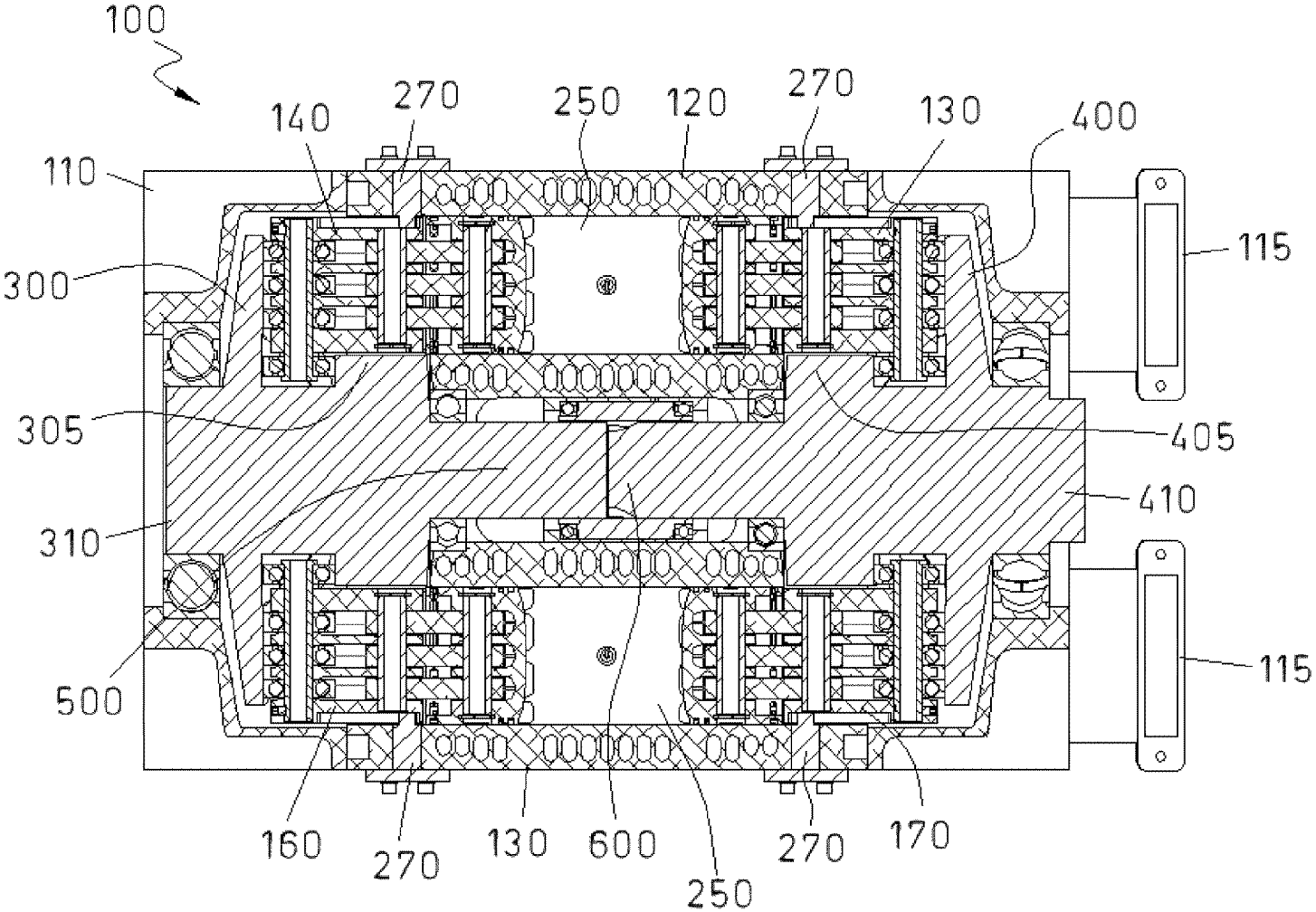
FIG. 14 is a cross-sectional view taken along line B-B' in FIG. 13.
Figure 16:
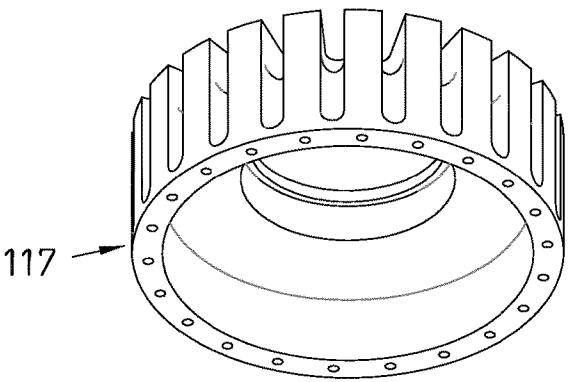
FIG. 16 is a perspective view of one side crankcase of the engine.

The engine 100 shown in the figures further comprises two mutually opposed power cams 300, 400 as shown in FIGS. 2 and 3 of the drawings and in greater detail, disassembled from the engine 100, in FIGS. 11 and 12. The power cams 300, 400 are rotatably fitted inside the engine block 110 at the opposite ends thereof, facing each other.

As shown in FIGS. 11 and 12, each power cam has cam tracks 315, 316, 415, 416. The cam tracks 315, 316, 415, 416 are shaped such that each half turn of the first and second rotary shafts 500, 600 causes a complete combustion and completes the thermodynamic cycle.

Specifically, FIGS. 11 and 12 illustrates intake cam tracks 315, 316 and exhaust cam tracks 415, 416 of the power cams 300, 400. Intake cam tracks 315, 316 are equal to one another. Exhaust cam tracks 415, 416 are equal to one another.

Said cam tracks 315, 316, 415, 416 are defined by respective protruding areas or protrusions formed therein as shown in said FIGS. 11 and 12. The intake cams track control the movement of intake pistons, that is, pistons associated with the engine intake stroke while exhaust cam tracks control the movement of exhaust pistons, that is, pistons associated with the engine exhaust stroke depending upon the stroke in use.

Opening and closing of the ports is thus controlled by the profile of each of the cam tracks 315, 316, 415, 416 in a way that the exhaust piston is advanced with respect to the intake piston. Therefore, before at the end of the power stroke, opening of the exhaust port is carried out before opening of the intake port and at the beginning of the compression exhaust port closes before closing the intake port.

Respective output shafts 310, 410 are connected to the respective power cams 300, 400, as shown in FIGS. 11 and 12. The output shafts 310, 410 can be attached to the power cams 300, 400 or they can be integrally formed therewith.

First and second rotary shafts 500, 600 are also provided inside the engine block 110, in a substantially central portion, as shown in FIG. 4. The first and second rotary shafts 500, 600 are aligned to each other, with their free ends next to each other but not in contact with each other. The first and second rotary shafts 500, 600 are connected to or are formed integral with the respective power cams 300, 400, as shown in FIGS. 11 and 12.

Figure 7:
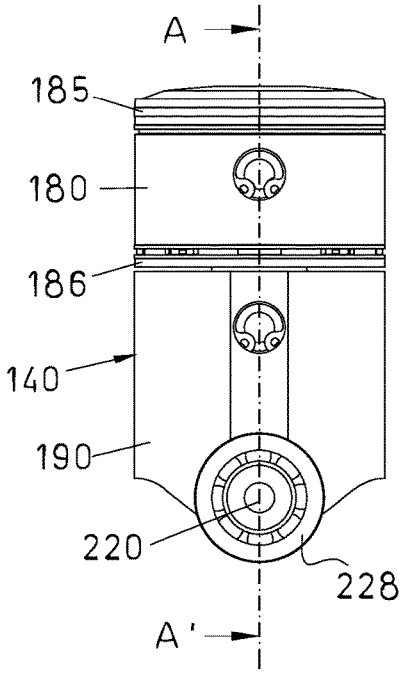
FIG. 7 is a side elevational view of one piston.
Figure 8:
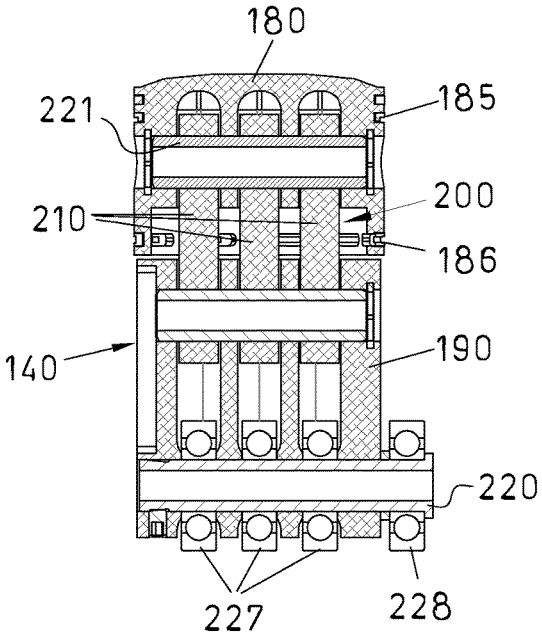
FIG. 8 is a cross-sectional view taken along line A-A' in FIG. 7.
Figure 9:
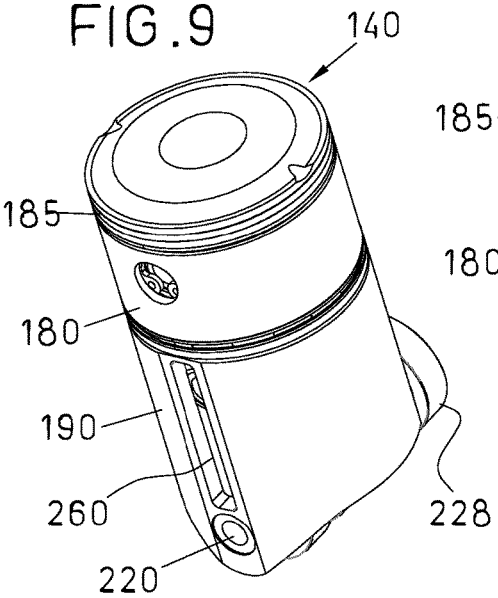
FIGS. 9 and 10 are perspective views of the piston shown in FIGS. 7 and 8 taken from different sides.

Turning to FIGS. 7-10, the pistons 140, 150 and 160, 170 have a respective drive end. The drive end in each of the pistons 140, 150 and 160, 170 comprises three cam follower wheels 227. The follower wheels 227 are adapted to roll on the respective power cams 300, 400. The drive end in each of the pistons 140, 150 and 160, 170 further comprises the above mentioned counter cam follower wheel 228. Said counter cam follower wheel 228 is adapted to roll on respective counter cams 305, 405 which will be described in greater detail according to FIGS. 3, 4, 11, 12 and 15 of the drawings. The four wheels 227, 228 in the drive end of each piston 140, 150 and 160, 170 are mounted on the above mentioned common shaft 220 as shown in FIGS. 7, 8 and 10. The common shaft 220 is arranged perpendicular to said first and second shafts 500, 600 and to the longitudinal axis X of the pistons 140, 150 and 160, 170.

In operation, the follower wheels 227 roll on the respective first and second power cams 300, 400. Reciprocation of pistons 140, 150 and 160, 170 against the power cams 300, 400 results in that a rotating motion is imparted to the first and second rotary shafts 500, 600 to drive the engine 100, causing the output shafts 310, 410 to be rotated.

Reference is now made to FIGS. 3-6 of the drawings. As shown in FIG. 3, the first and second rotary shafts 500, 600 of the engine 100 are linked to each other through an attachment device 700. The attachment device 700, that has been removed from the engine 100 in FIG. 4 for the sake of clarity in order to show the first and second rotary shafts 500, 600, is arranged inside the engine block 110. The attachment device 700 connects the first and second rotary shafts 500, 600 to each other so that they can be rotated together in operation.

Figure 5:
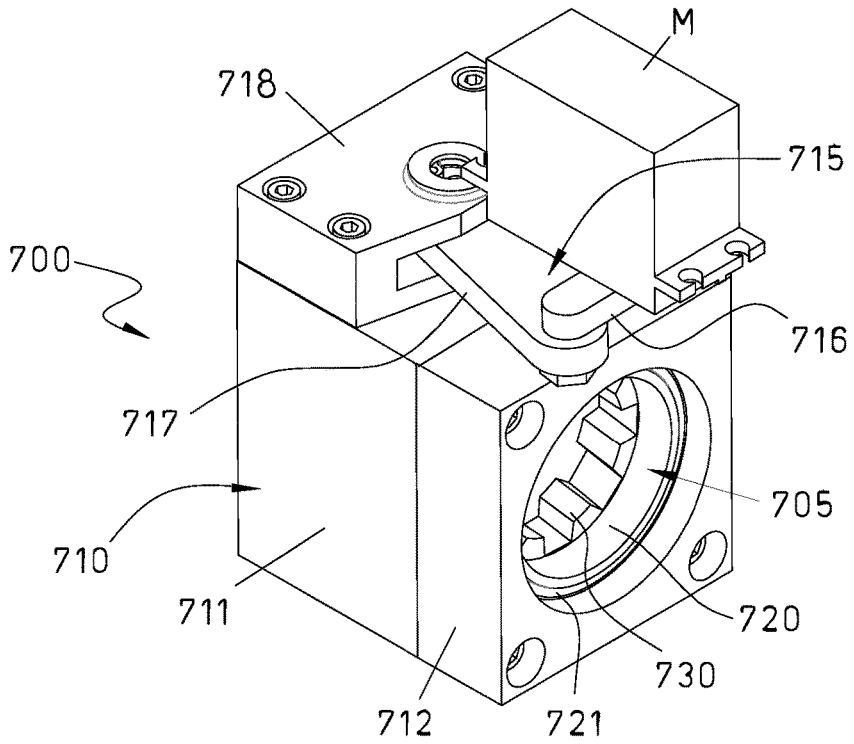
FIG. 5 is a perspective view of the attachment device.
Figure 6:
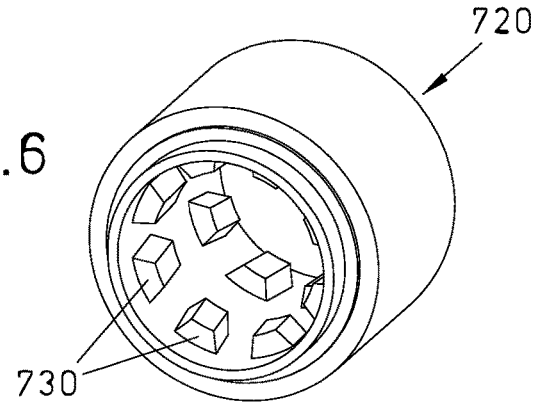
FIG. 6 is a perspective view of the slider of the attachment device.

Said attachment device 700 is shown in detail in FIG. 5. The attachment device 700 comprises shifting means 705. In the embodiment shown in FIG. 5, the shifting means 705 include a slider 710. The slider 710 comprises two main bodies 711, 712 attached to each other. The slider 710 is commanded by a control unit (not shown) causing it to be displaced along the longitudinal axis of the first and second rotary shafts 500, 600 through a motor means comprising a servomotor M. Other motor means controlled by the control unit (not shown) for displacing the slider 710 are not rule out, such as motor means comprising a hydraulic motor.

The slider 710 includes an inner bushing 720 rotatably mounted therein through bearings 721. In an inner surface of bushing 720, shown in detail in FIG. 6, a number of helical teeth 730 are provided. The inner bushing helical teeth 730 are arranged to engage the respective helical teeth 505, 605 formed at the respective mutually adjacent or proximate ends of the first and second rotary shafts 500, 600 as shown in FIGS. 4, 11 and 12.

The driving assembly 715 comprises a driving arm 716 acting on a connecting rod 717. The connecting rod 717 of the driving assembly 715 connects the driving arm 716 with the main bodies 711, 712 of the slider 710 through a fork element 718 attached to them.

As the slider 710 is actuated, that is, as it is displaced along the first and second rotary shafts 500, 600 by the servomotor M that is commanded by the control unit, through driving assembly 715, engagement of helical teeth 730 of the slider 720 with helical teeth 505, 605 of the first and second rotary shafts 500, 600 causes the relative angular position of the first and second rotary shafts 500, 600 to be changed so that they are mutually rotated slightly. This occurs due to the symmetric arrangement of the helical teeth 730, 505, 605 of the slider 720 and the first and second rotary shafts 500, 600.

The intake and exhaust power cams 300, 400 in this specific example are equal to each other. Therefore a suitable angular shift exists between the power cams 300, 400. In this specific example, the angular shift is of the order of 4.5°. This means that the exhaust power cam is advanced relative to the intake power cam. This is an initial angular shift between the power cams which is not caused by the attachment device 700 but is due to the design of the helical teeth 730, 505, 605 of the slider 720 and the first and second rotary shafts 500, 600. Then, from the starting position (idling), as the engine 100 is running the slider 710 can travel a maximum displacement of the order of 16 mm and as a consequence the power cams 300, 400 are rotated to each other, that is, the exhaust power cam is advanced relative to the intake power cam, up to 12.8° in this specific example. This however may vary depending upon gear pitch, teeth shape (whether they are constant or variable radius teeth, etc).

In operation, pistons 140, 150 and 160, 170 act, through their respective drive end, on the power cams 300, 400 causing them, together with the first and second rotary shafts 500, 600, to be rotated in the same direction while the slider 710 is actuated, that is, displaced along them, causing the engine distribution and compression ratio are changed.

As stated above and as shown in FIGS. 3, 4, 11, 12, respective counter cams 305, 405 are provided in correspondence with each power cam 300, 400. The counter cams 305, 405 are received in respective recesses 240 formed at both ends of the engine block 110 as shown in FIG. 15. The counter cams 305, 405 are attached to or are part of the respective first and second shafts rotary 500, 600. The counter cams 305, 405 are attached to or are part of the respective power cams 300, 400. As shown in FIGS. 11, 12, the diameter of the counter cams 305, 405 is smaller than that of the power cams 300, 400. The counter cams 305, 405 have the same shape and they are facing each other. The counter cams 305, 405 are adapted to prevent pistons 140, 150 and 160, 170 from losing contact with the cam tracks 315, 316, 415, 416 of the power cams 300, 400 and thus to prevent possible collisions with each other which might occur when inertial forces of the pistons 140, 150 and 160, 170 are in opposite direction to those of the power cams 300, 400 and the gas pressure inside the cylinder or cylinders 120, 130 is lower than said inertial forces.

Although only a number of particular embodiments and examples of the present engine have been disclosed and shown herein, it will be understood by those skilled in the art that other alternative embodiments and/or uses and obvious modifications and equivalents thereof are possible.

For example, although shifting means 705 have been disclosed herein as comprising a slider 710 such that as it is moved along the longitudinal axis of the first and second rotary shafts 500, 600, said first and second rotary shafts 500, 600 are rotated to each other, other alternative mechanical embodiments are possible. For example, the shifting means 705 might comprise a rotary actuator. As such actuator is rotated, the first and second rotary shafts 500, 600 are rotated to each other resulting in that the engine distribution and compression ratio are changed as stated above.

The present disclosure thus covers all possible combinations of the particular embodiments of the engine described. Reference signs related to drawings and placed in parentheses in a claim, are solely for attempting to increase the intelligibility of the claim, and shall not be construed as limiting the scope of the claim. Thus, the scope of the present disclosure should not be limited by particular embodiments, but should be determined only by a fair reading of the claims that follow.

The invention claimed is:

1. A internal combustion engine, comprising:

at least one cylinder provided with corresponding pistons arranged to reciprocate along a longitudinal axis of the at least one cylinder, and at least first and second power cams mutually opposed and connected to respective first and second rotary shafts, whereby reciprocation of the pistons results in that the pistons act on the first and second power cams to thereby impart a rotating motion to the first and second rotary shafts to drive the engine, wherein the engine further comprises an attachment device for connecting the first and second rotary shafts to each other so that the first and second rotary shafts rotate together, the attachment device comprising a shifting device for changing a relative angular position of the first and second rotary shafts, and wherein the pistons comprise at least one counter follower wheel adapted to roll on a counter cam and the cylinder has an indentation formed at opposite ends thereof so that the counter follower wheel does not collide with the cylinder; and wherein each of the indentations form a longitudinally extending open space in the cylinder wall, within which the counter follower wheel reciprocates as the pistons reciprocates along the longitudinal axis of the cylinder.

2. The engine of claim 1, wherein the shifting device comprises a slider including teeth suitable to engage with respective teeth in the first and second rotary shafts such that, as the slider is moved along the longitudinal axis of the first and second rotary shafts, the first and second rotary shafts are rotated relative to each other.

3. The engine of claim 2, wherein the teeth of both the slider and the first and second rotary shafts are helical, with the teeth of the first rotary shaft being symmetrical with respect to the teeth of the second rotary shaft.

4. The engine of claim 2, wherein a plane of symmetry of the teeth in the first and second rotary shafts is perpendicular to the first and second rotary shafts.

5. The engine of claim 2, wherein the shifting device includes a driving arrangement to actuate the slider.

6. The engine of claim 1, wherein the counter cam prevents the pistons from losing contact with the power cam.

7. The engine of claim 1, wherein each power cam is provided with at least one cam track.

8. The engine of claim 7, wherein each cam track is defined by two respective protruding areas designed such that in a power stroke exhaust ports are opened before the intake ports, and in a compression stroke exhaust ports are closed before the intake ports.

9. The engine of claim 7, wherein a profile of the cam tracks in the power cams is similar or equal to one other.

10. The engine of claim 7, wherein the respective cam tracks comprises at least an ascending or compressing portion and a descending or power portion.

11. The engine of claim 10, wherein the respective cam tracks further comprises at least an additional flat portion between the compressing and the descending portions.

12. The engine of claim 1, wherein the engine is a three stroke engine.

13. The engine of claim 1, wherein the pistons comprise a piston head, a piston body and a connector for connecting the piston head with the piston body.

14. The engine of claim 13, wherein a combustion chamber is defined within the cylinder and a space formed by the combustion chamber is between two adjacent piston heads in the cylinder.

15. The engine of claim 14, wherein the piston head carries compression piston segments arranged at one end of the piston head near the combustion chamber and lubrication piston segments arranged in a lowermost part of the piston head.

16. The engine claim 13, wherein the piston body has an indentation formed in opposite ends preventing the piston body from colliding against a cam track during a compression and power stroke of the engine.

17. The engine of claim 1, wherein the engine further comprises a locking mechanism for preventing the pistons from being rotated relative to the cylinder.

18. The engine of claim 1, wherein the engine comprises a finned area provided around the cylinder through which cooling fluid can flow.

19. The engine of claim 1, wherein the cylinder has, at one side, intake ports controlled by the pistons, which in turn are controlled by corresponding cam tracks provided in a power cam, and exhaust ports controlled by the pistons which in turn are controlled by corresponding cam tracks provided in an opposite power cam.

* * * * *